US005439217A

United States Patent [19]

Ganger, Sr.

[11] Patent Number: 5,439,217

[45] Date of Patent: * Aug. 8, 1995

[54] METHOD AND TRAINING DEVICE TO ASSURE SPORTSMEN A PROPER GRIP WITH MEMBRANE SWITCH

[75] Inventor: David E. Ganger, Sr., Cape Coral, Fla.

[73] Assignee: Tone Trainer, Inc., Cape Coral, Fla.

[ * ] Notice: The portion of the term of this patent subsequent to Jul. 11, 2012 has been disclaimed.

[21] Appl. No.: 274,213

[22] Filed: Jul. 13, 1994

Related U.S. Application Data

[63] Continuation-in-part of Ser. No. 53,485, Apr. 29, 1993, Pat. No. 5,322,281, Ser. No. 230,106, Apr. 20, 1994, and Ser. No. 230,199, May 17, 1994.

[51] Int. Cl.[6] ..... A63B 59/00

[52] U.S. Cl. ..... 273/75; 273/29 A; 273/73 R; 273/187.5; 273/183.1

[58] Field of Search ..... 273/29 R, 29 A, 73 R, 273/73 J, 75, 81 R, 81 D, 32 R, 35 R, 187.5, 183.1

[56] References Cited

U.S. PATENT DOCUMENTS

| | | |
|---|---|---|
| 3,323,367 | 6/1967 | Searle . |
| 3,762,720 | 10/1973 | Jett . |
| 4,027,879 | 6/1977 | Wright . |
| 4,101,132 | 7/1978 | Conrey et al. . |
| 4,103,896 | 8/1978 | Lorang . |
| 4,138,118 | 2/1979 | Budney . |
| 4,822,042 | 4/1989 | Landsman . |
| 4,861,034 | 8/1989 | Lee . |
| 4,930,785 | 6/1990 | Mills . |
| 5,031,909 | 7/1991 | Pecker . |
| 5,221,088 | 6/1993 | McTeigue et al. . |

FOREIGN PATENT DOCUMENTS

| | | |
|---|---|---|
| 2626483 | 8/1989 | France . |
| 1587191 | 4/1981 | United Kingdom . |
| 2250923 | 6/1992 | United Kingdom . |

OTHER PUBLICATIONS

Tennis Science for Tennis Players by Howard Brody, Publisher University of Pennsylvania Press, Philadephia, 1987 pp. 57–60.

Step by Step Tennis Skills, The Definitive Guide to Winning Play, Hamlyn Publishing Group 1991. p. 31.

Tennis by Pancho Gonzales and Dick Hawk, publisher Angel Books—New York, 1972, pp. 25–26.

Sports Illustrated book of Tennis, publisher J. B. Lippincott.

Efficiency Racquet Sports, Gene R. Hagerman et al., publisher Bantam Books, 1987. p. 23.

*Primary Examiner*—Raleigh W. Chiu

*Attorney, Agent, or Firm*—Cesarano & Kain

[57] ABSTRACT

The training device, to assure a proper grip, utilizes a thin sheet wrap sized to wrap around an outside grip surface of a racket handle, or a golf club handle or a hand grip surface. A non-domed membrane switch, is retained by the thin sheet wrap. A releasable element, such as a glue, strap or attachment mechanism, is utilized to secure the wrap on the handle. A portable power source is electrically coupled to an audible alarm, both of which are in turn electrically connected to the switch. When the switch closes, the alarm sounds. Piezoelectric pressure sensors can also be utilized. The method includes removably mounting at least one membrane switch with a wrap about a handle, mounting a portable power supply and an audible alarm on the racket, club or near the grip surface, electrically connecting together the power supply, alarm and switch, compressibly closing the switch with a proper hand grip over a distance which does not exceed the thickness of the wrap, and audibly announcing the closure of the switch by activation of the alarm. By audibly indicating unnecessary or excessive hand gripping force, the user is audibly prompted to release his or her grip, thereby reducing stress throughout his or her body.

25 Claims, 12 Drawing Sheets

METHOD AND TRAINING DEVICE TO ASSURE SPORTSMEN A PROPER GRIP WITH MEMBRANE SWITCH

This is a continuation-in-part of U.S. patent application Ser. No. 08/053,485, filed Apr. 29, 1993, now U.S. Pat. No. 5,322,281, issued Jun. 21, 1994, a continuation-in-part of U.S. patent application Ser. No. 08/230,106, filed Apr. 20, 1994, now pending, and a continuation-in-part of U.S. patent application Ser. No. 08/230,199, filed May 17, 1994, now pending.

BACKGROUND OF THE INVENTION

1. Field of the Invention

The present invention relates to a device and its method of use that would confirm to the player, of various sports, that proper hand position, with a sufficiently firm grip, was established and was being maintained. It should be noted that a consistent hand position aids the player in establishing a proper relationship with the ball. This invention would be installed, by the user, by attaching the apparatus so as to surround the handle, and be securely attached thereto, on existing sports equipment. The purpose of the present invention is to prevent the player from attempting play without proper the form, hand position and firmness of grip. The invention would have at least one sensor device in the form of a pressure activated switch, a membrane switch or piezoelectric sensor. These switches would be such that the individual player could align, and thus adjust, them at the desired pressure points on the grip. This would allow the player to position the sensors so as to be activated by the proper pressure points at appropriate racket locations by his or her specific hand.

The present invention also relates to a grip sensor for golf clubs and a biofeedback, stress reduction training device which audibly indicates excessive gripping force on the hand grip surface. These hand grip surfaces may include any surfaces which are gripped by a user. For example, in a hand glider, it is important that the user lightly grip the hand bars. The grip sensors, in accordance with the principles of the present invention, assist the user to reduce the stress in his or her hand through bio-feedback, audible response tones, and hence reduce excessive gripping force and excessive body and mental stress.

2. Brief Description of the Prior Art

Many sports use equipment that is carried by the individual players during play. Proper hand position and a firm grip are stressed during the training of players in many of these sports. Currently there is known in the art various handles that attempt to cause the player to maintain proper hand position and grip pressure. These grip locators are shaped with a variety of various indentations that cause the player to properly position his or her hands on the grip in order to comfortably hold the equipment. These grips are such that customization with respect to a particular player, i.e., hand size, is difficult and expensive. These grips also fail to address the problem of maintaining a firm grip.

U.S. Pat. No. 4,861,034 to Lee discloses a golf grip training device. The Lee device includes an audible buzzer or alarm unit containing a battery and an audible alarm. The audible alarm unit is strapped to the shaft of the golf club with a VELCRO-like attachment. The switching mechanism includes a housing which is elongated and is strapped onto the handle portion of the golf club shaft. The thickness of the switch housing is generally equivalent to the radial dimension of the handle of the golf club shaft. The switch housing includes three contacts which are separated and spaced apart by a plurality of compressible foam blocks. When the golfer depresses the elongated switch assembly, opposing touch and the audible alarm issues one type of tone. Upon further compression, all three contacts are forced together to electrically connect and the audible device issues a second tone.

French Patent Publication No. 2,626,483 discloses a grip training device for a golf player. This device issues a visible and an audible alarm dependent upon the change in resistance or an optical transmission caused by pressure applied by the grip of the golfer.

U.K. Patent Publication No. 2,250,923 to Yeh discloses a sports racquet which issues visible and audible alarms whenever the ball hits the racquet. Concussion switches are mechanically connected to the racquet webbing and the center circuit issues the alarm signal upon impact of the ball on the webbing of the racquet.

U.S. Pat. No. 3,326,367 to Searle discloses a grip device for golfers which senses the change in resistance on the grip surface.

U.S. Pat. No. 3,762,720 to Jett discloses a golf training device which utilizes a depressible compression switch in a handle of the golf shaft.

U.S. Pat. No. 4,027,879 to Wright discloses a tennis training device which requires the player to forcibly squeeze the tennis racquet during the stroke. If the player does not properly grip the racquet during the stroke, the neck member will move away from the end of the grip member and the stop knob, which is an internal element in the training device, will contact the slide collar. Upon such contact, a visual and audible alarm sounds. The Wright tennis training device is threadably attached to a specially configured tennis racquet and includes a movable slide collar with an internal part which moves on an internal shaft within the training device.

U.S. Pat. No. 4,101,132 to Conrey et al. discloses a tennis racquet sensory system which includes a plurality of electronic sensors coupled to selected strings on the racquet. When the sensors detect the striking of the ball on a racquet, an audible or visual alarm is sounded.

U.S. Pat. No. 4,103,896 to Lorang discloses a golf grip training device which includes a compressible switch.

U.S. Pat. No. 4,138,118 to Budney discloses a golf club grip training device which includes a plurality of sensors at predetermined locations on the handle of the shaft of the club. When the players hands are properly positioned on the grip and exert a specific amount of pressure, the sensors generate signals which are used to log the grip of the player on the club thereby permitting the recording of the pressure and positioning of the hand of the golfer.

U.S. Pat. No. 5,031,909 to Pecker discloses an electronic device which uses four sensors coupled to selected strings on a tennis racquet. Upon impact of the ball and the racquet, these sensors actuate an alarm.

U.S. Pat. No. 5,221,088 to McTeigue et al. discloses a golfing training device utilizing grip sensors and foot sensors coupled via radio frequency to a head set and a decoder.

U.S. Pat. No. 4,822,042 to Landsman discloses a electronic device which measures the shock waves on strings of a racquet.

U.S. Pat. No. 4,950,785 to Mills discloses a golf grip training device utilizing a compressible switch which triggers an alarm circuit in the interior of the shaft of the golf club.

U.K. Patent Publication No. 1,587,191 to Stewart discloses a grip pressure indicator for a golfer utilizing a compressible graduated pressure switch.

Objects of the Invention

The principal object of the invention is to assure sports persons of a proper grip on the sports equipment in use. Several other objects and advantages of the present invention are:

(a) to provide a method of confirming to the player that proper hand position has been established on the sports equipment in use.

(b) to provide a method of confirming to the player that a sufficiently firm grip has been established on the sports equipment in use.

(c) to provide a method of alerting the player that proper hand position on the sports equipment has been lost during play.

(d) to provide a method of alerting the player that his or her firm grip on the sports equipment is not being maintained during play.

(e) to provide the player with the ability to position the pressure activated switches or other type of switches, incorporated in the apparatus, in such a way as to match predetermined positions of the fingers and palm of the hand of the player.

(f) to provide the player with the ability to select the lower threshold of activation of the audio signal so as to allow the training device to be used by players of varying hand strengths.

(g) to provide for the rehabilitation of stroke and other disabled persons by allowing the establishment of goals with the devices use in therapy. One usage would establish a lower threshold of pressure and allow the patient to repeatedly achieve this goal. It would optionally allow for monitoring of the duration of time that the goal was met with each repetition. The threshold of pressure or the duration of time achieved could then be increased as the patient progresses in the therapy.

(h) to provide for a device which could be secured to the steering wheel of a vehicle where it would emit an audio signal when the pressure applied by the grip of the hand lessened. This would provide for a method of alerting the driver that their attention is diminishing.

It is an object of the present invention to utilize a membrane switch, and preferably a non-domed membrane switch, which detects the location and the degree of compressive force of a player's grip on a sports racket.

It is another object of the present invention to utilize a variable threshold detection device to sense the degree of compressive force of a player's grip and issue one or more audible alarms to the player indicative of the location and the amount of griping force on the sports racket.

It is an additional object of the present invention to securely locate the power source, preferably a battery, and the audible alarm in an open yoke of a tennis or sports racket thereby positioning and locating the weight of the device close to the normal or customary center of gravity of the racket.

It is a further object of the present invention to releasably affix the wrap carrying the switches to the racket handle.

It is another object of the present invention to utilize one or more piezoelectric switches to assure adequate grip location and compressive force on a sports racket.

It is another object of the present invention to provide a method of electronically training a player to properly locate his or her grip and adequately compress or grip the sports racket handle.

It is a further object of the present invention to provide a grip sensor for a golf club handle.

It is an additional object of the present invention to provide a grip sensor for a golf club handle which utilizes forward and aft located, serially connected grip sensor switches.

It is another object of the present invention to provide a bio-feedback stress reduction training device which audibly indicates excessive gripping force on hand grip surfaces.

It is a further object of the present invention to provide an electronic training method for audibly indicating a proper hand grip by a player on a golf club handle.

It is an additional object of the present invention to provide an electronic, biofeedback, stress reduction training method which audibly indicates an excessive gripping force on a hand grip surface.

Other objects and advantages of the invention will become apparent to those skilled in the art from the detailed description which follows. It should be understood, however, that the detailed description, while indicating preferred embodiments, is given as an example and not a limitation. Many changes and modifications to the invention are possible without departing from the spirit and scope of the invention, and all such modifications are included in the claims appended hereto.

BRIEF DESCRIPTION OF THE DRAWINGS

Like references numerals refer to like elements throughout the various illustrations.

SUMMARY OF THE INVENTION

Figure 1:
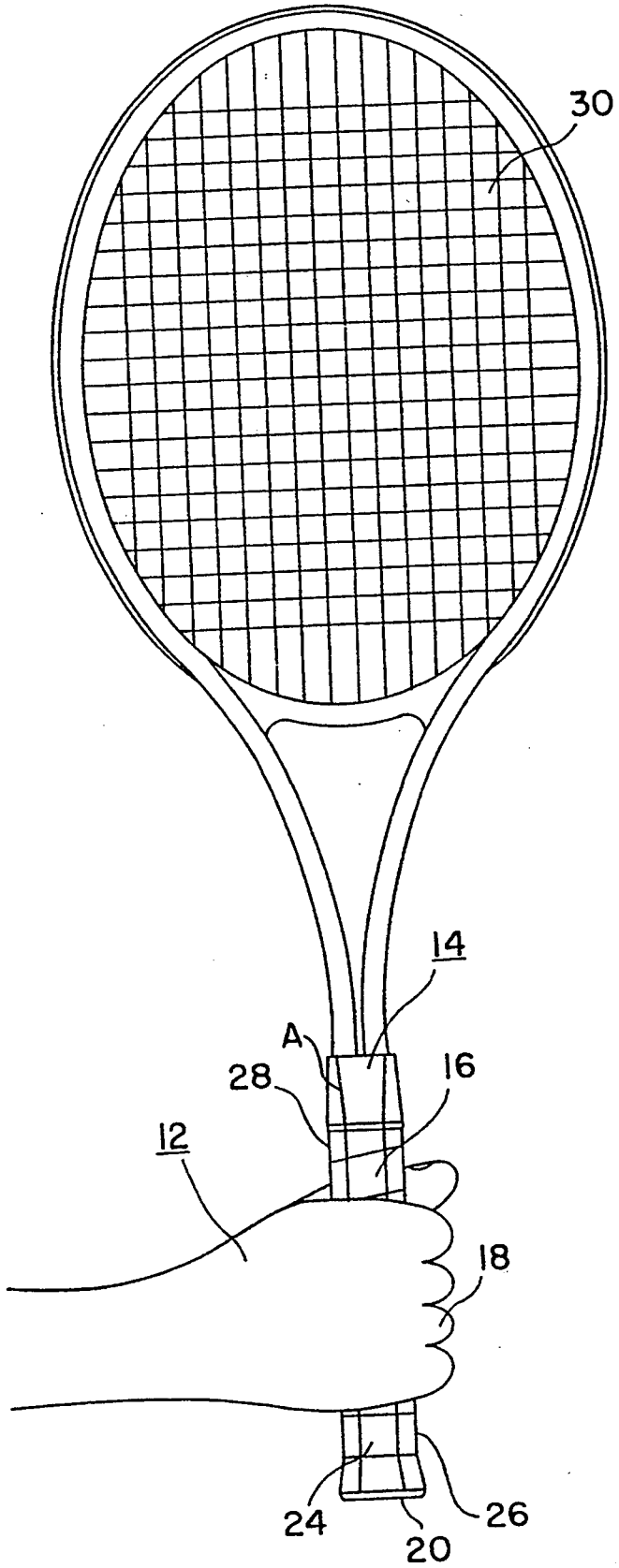
FIG. 1 is a plan view of a tennis racket being gripped by a hand.

It would be extremely desirable to have a device that would audibly indicate to the player that his or her grip was proper on a sports racket. This invention is designed to perform this task and thus will be an aid to players of many sports. It would allow the individual player to concentrate on the other aspects of the respective game without concern that the grip and hand location fundamentals of that game were not present.

In one embodiment, the training device utilizes a thin sheet wrap sized to wrap around an outside grip surface of a racket handle, or a golf club handle or a hand grip surface. A non-domed membrane switch, in a preferred embodiment, is retained by the thin sheet wrap. A releasable means, such as a glue, strap or attachment mechanism, is utilized to secure the wrap on the handle. This releasable means can be a releasable adherent. A portable power source is electrically coupled to an audible alarm, both of which are in turn electrically connected to the switch. When the switch closes, the alarm sounds. Piezoelectric pressure sensors can also be utilized. The method includes removably mounting at least one membrane switch with a wrap about a handle, mounting a portable power supply and an audible alarm on the racket, club or near the grip surface, electrically connecting together the power supply, alarm and switch, compressibly closing the switch with a proper hand grip over a distance which does not exceed the thickness of the wrap, and audibly announcing the closure of the switch by activation of the alarm.

By audibly indicating unnecessary or excessive hand gripping force, the user is required to release his or her grip thereby reducing stress throughout his or her body.

DESCRIPTION OF THE PREFERRED EMBODIMENTS

Referring now to the drawings, FIG. I shows a plan view of a racket 14 being properly gripped by a hand 12 having fingers 18 at grip 16. Grip 16 has side 24, side 26 and side 28. Grip 16 has a fourth side not shown in FIG. 1. Racket 14 further has base 20 and racket body 30. Racket body 30 is utilized during play to strike a tennis ball.

Figure 2:
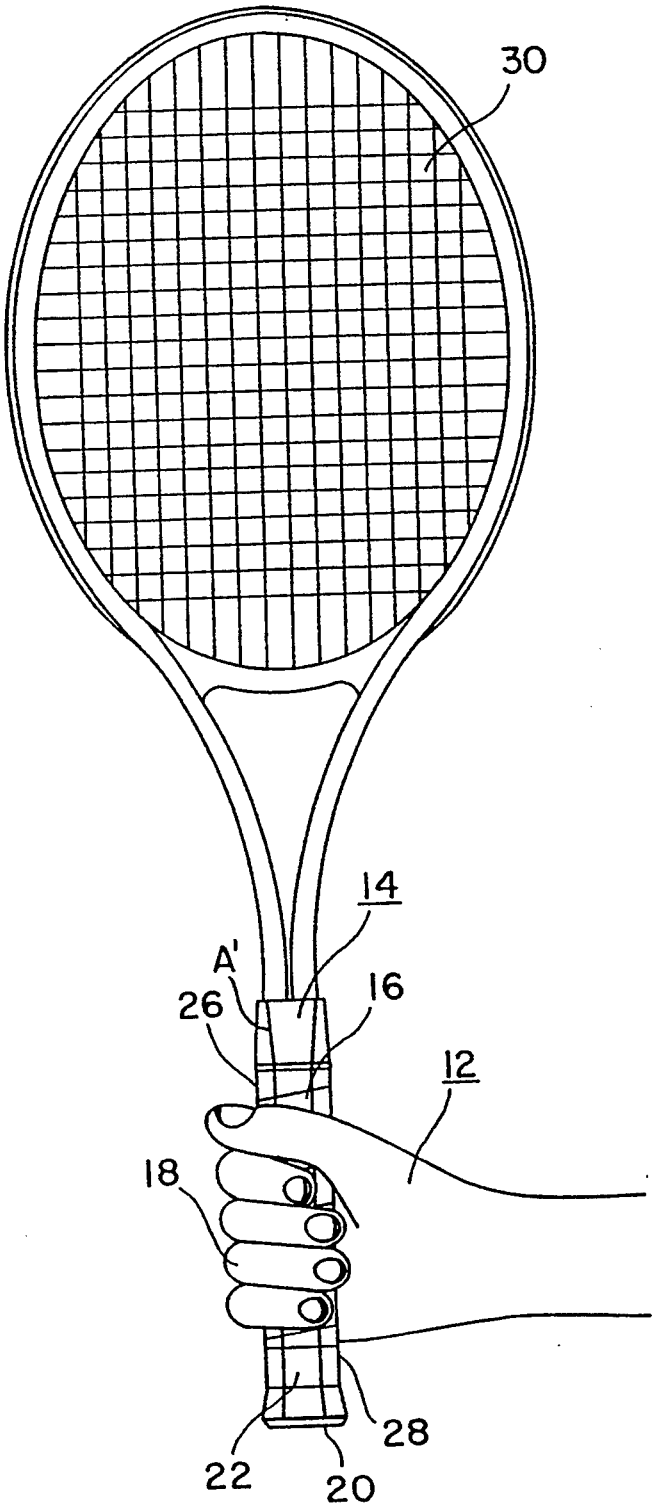
FIG. 2 is a plan view of the opposing side of the tennis racket and hand shown in FIG. 1.

FIG. 2 shows a plan view of the opposing side of racket 16 as illustrated in FIG. 1. Hand 12 is shown gripping racket 14 utilizing grip 16. Hand 12 and fingers 18 grip the racket handle. Grip 16 has side 22, side 26 and side 28. It being understood that grip 16 has a fourth side not shown in FIG. 2. Racket 14 further has base 20 and racket body 30. FIGS. 1 and 2 illustrate longitudinal alignment indicia or breaks A and A'.

It being understood that while a tennis racket is utilized for the preferred embodiment that many different pieces of sports equipment could be utilized with the invention.

Figure 3:
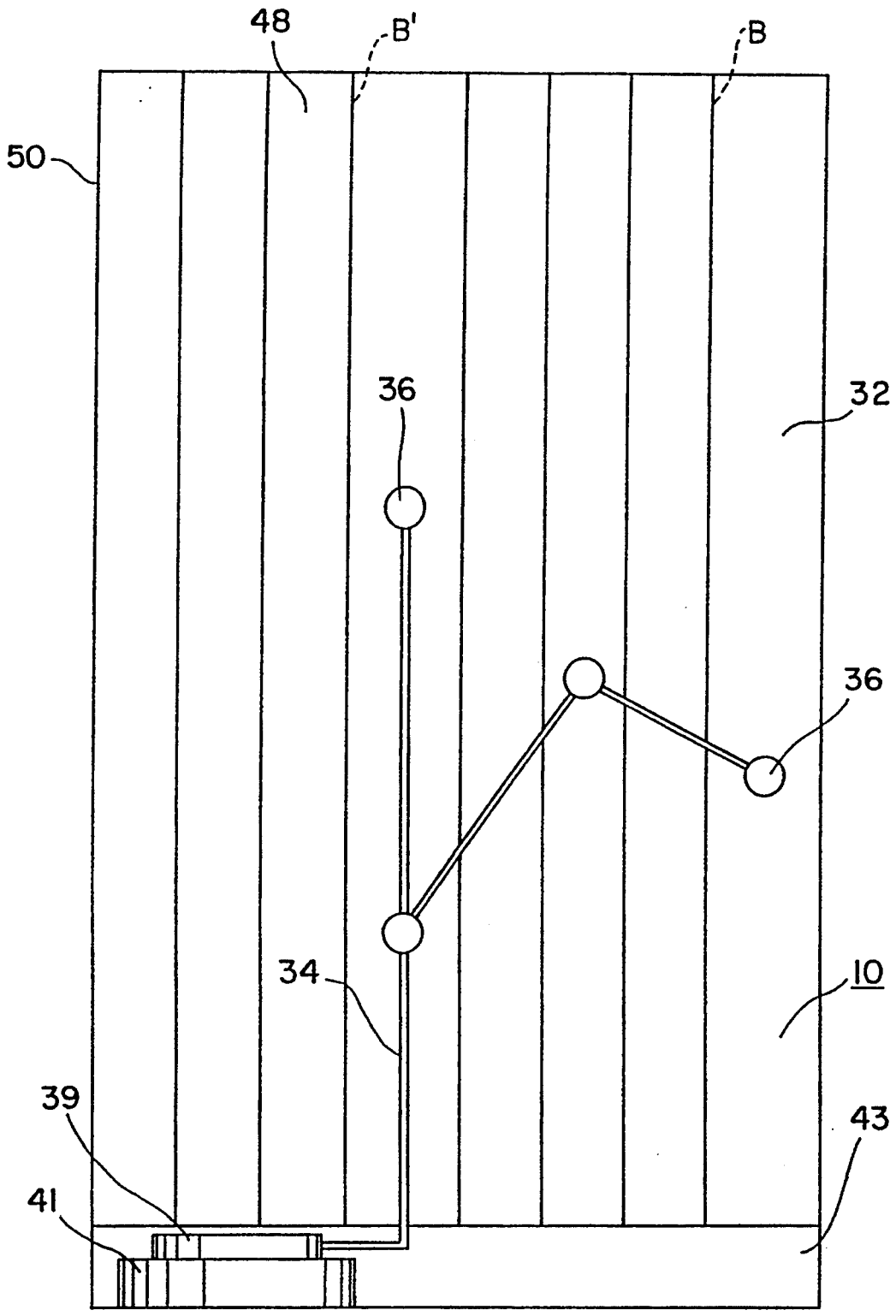
FIG. 3 is a plan view of one embodiment of the training device laying flat.

FIG. 3 shows a plan view of device 10. Device 10 is illustrated flat in this view while the device would be wrapped around, enclose and be securely attached to the grip of the desired piece of sports equipment when in use. A releasable adherent or glue is used on the inside surface of the wrap such that the wrap can be attached during training sessions and removed during tournament play. Other attachment systems (straps, clips, VELCRO hook and loop strips, etc.) may be used. Shown in FIG. 3 is a wrap 32 having an inner surface 48 and an outer surface 50. Inner surface 48 would be in contact with the grip of the racket or chosen sports equipment and a portion of outer surface 50 would be in contact with the players hand. Attached to inner surface 48 are switches 36 connected together utilizing wire 34. Wire 34 is capable of conducting electricity. Wrap 32 further includes base 43 having attached thereto battery 39 and speaker 41. Battery 39 is connected to speaker 41. Battery 39 and speaker 41 are attached to switches 36 utilizing wire 34. Speaker 41 is an audio signal generating device. As stated earlier, the switch may be a pressure activated switch.

FIG. 3 also illustrates longitudinal alignment indicia B and B'. As stated earlier, the player may align the wrap and particularly alignment indicia B and B' with racket handle alignment indicia or breaks A and A' such that the wrap and, hence, the switches would be located at the desired grip pressure points on the racket handle.

Figure 4:
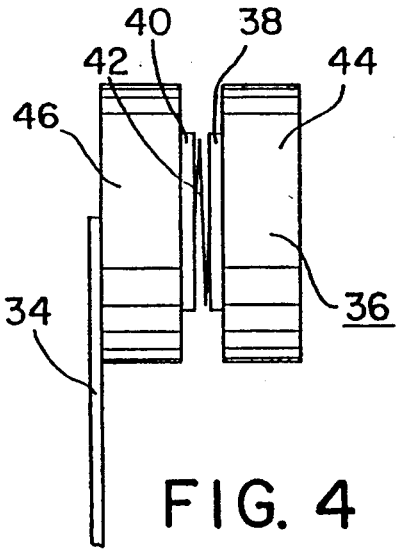
FIG. 4 is a plan view of one type of switch.

FIG. 4 shows a plan view of switch 36 having two sides 44 and 46. Attached to side 46 is wire 34 and connector 40. Attached to side 44 is connector 38. Connector 38 and connector 40 are held apart by spring 42. When sufficient pressure is applied to switch 36 so as to push side 44 toward side 46 connector 38 will come in contact with connector 40. When this occurs an electric charge flows through wire 34.

Figure 5:
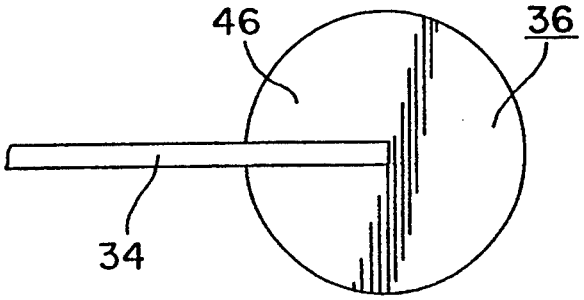
FIG. 5 is a plan view of a switch.

FIG. 5 shows a second plan view of switch 36. Shown is side 46 with wire 34 connected.

Figure 6:
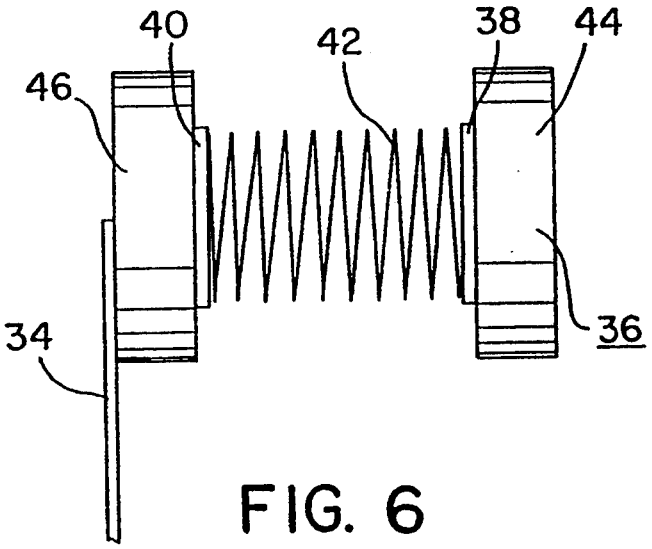
FIG. 6 is a plan view of a switch extended apart.

FIG. 6 shows a plan view of switch 36 in an extended form so as to illustrate spring 42 more fully. Switch 36 having side 44 with connector 38 attached. Switch 36 further having side 46 with connector 40 attached. Attached to side 46 is wire 34.

Device 10 would be installed on and surround the grip of existing sports equipment. Switches 36 would be positioned in such orientation so as to align with desired positions on the hand and fingers. When a sufficient pressure is applied to the switches 36 a closed circuit is formed and battery 39 sends an electric charge to speaker 41. Speaker 41 then generates an audio signal that confirms to the player that proper hand position with the desired pressure is present.

Figure 7:
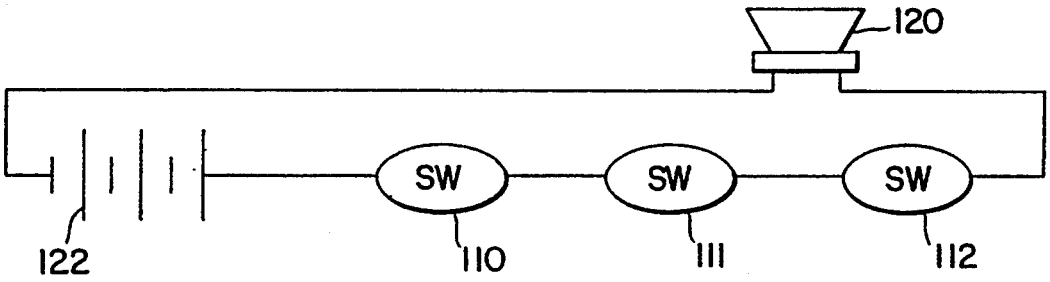
FIGS. 7 and 8 diagrammatically illustrate serial and parallel electrical configurations of the sensors which may be pressure sensitive switches, domed membrane switches, non-domed membrane switches or piezoelectric pressure sensors.
Figure 8:
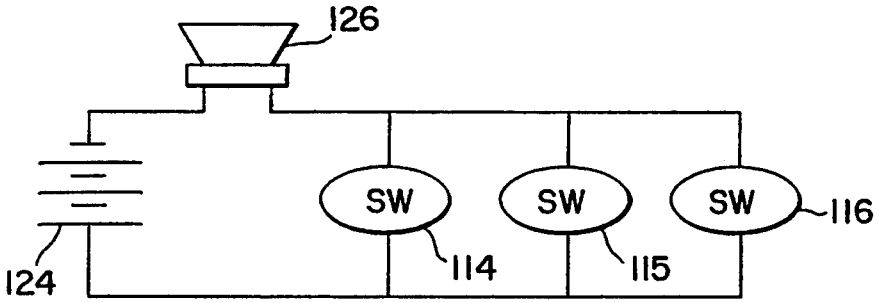

FIGS. 7 and 8 diagrammatically illustrate various electrical configurations for switches 110, 111, 112 (FIG. 7) and 114, 115, 116 (FIG. 8). Further, these switches can be replaced with piezoelectric sensors that generate a voltage differential or a current dependent upon the degree of pressure applied to the piezoelectric sensor. The claims appended hereto are meant to cover these types of pressure sensitive switches.

FIG. 7 illustrates switches 110–112 in series with a sound generator 120 and a portable power source or battery 122. Of course, there might be additional electrical circuits necessary to condition the signal prior to application to sound generator or alarm 120. These components are known to persons of ordinary skill in the art.

FIG. 8 diagrammatically illustrates switches or pressure sensors 114–116 in parallel with battery 124 and sound generator 126.

By serially connecting the switches or pressure sensors (FIG. 7), the player is required to apply a reasonable degree of pressure on each serially connected switch 110, 111, and 112 in order to sound alarm 120. In contrast thereto, if the switches 114, 115, and 116 are electrically connected in parallel with alarm or sound generator 126, the player need only compress one of the switches to a predetermined threshold in order to sound the training alarm. Dependent upon the type of alarm system and the type of grip to be used on a particular racket, the player or user may select the serially sensor device (FIG. 7) or the parallel sensor device (FIG. 8). Of course, a plurality of configurations can be devised utilizing pressure switches or sensors in parallel with other pressures sensors or switches in serial. FIG. 3 diagrammatically illustrates switches in various configurations.

Figure 9:
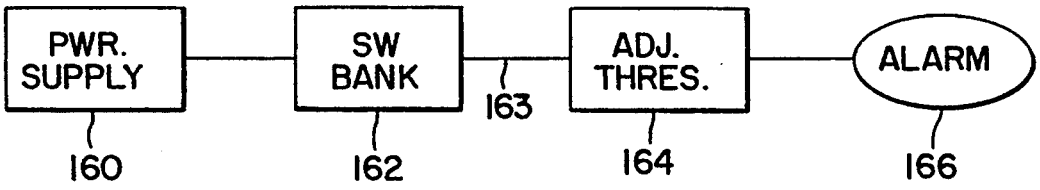
FIG. 9 diagrammatically illustrates an adjustable threshold control for the alarm.

FIG. 9 diagrammatically illustrates the adjustable threshold circuit as described earlier in object (f). In FIG. 9, a portable power supply 160 is electrically connected to a switch bank or pressure sensor bank 162 which is further electrically connected with an adjustable threshold circuit 164 and ultimately electrically connected to sound generator or alarm 166. Adjustable threshold circuit can be a simple electrical circuit that detects when the voltage on line 163 exceeds a predetermined level. In this sense, the switch bank or pressure sensors must generate variable voltages. Other thresholding devices can be utilized including, but not limited to, microprocessor-based systems. For example, the adjustable control may "switch in" additional pressure sensors spaced apart on the wrap or web removably attached to the racket handle.

Figure 10:
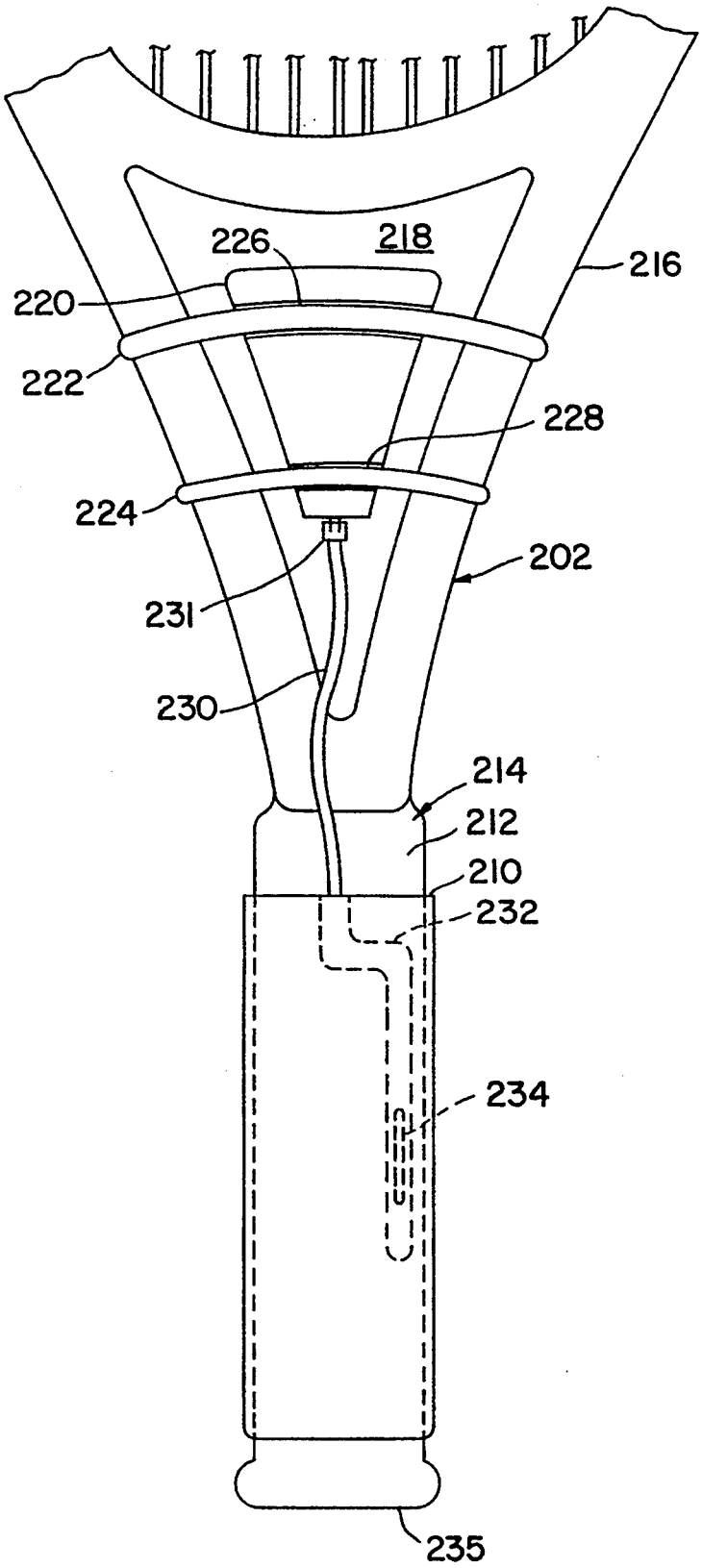
FIG. 10 diagrammatically illustrates another embodiment of the invention with the power source and audible alarm mounted in an open yoke of a tennis or sports racket.

FIG. 10 diagrammatically illustrates another embodiment of the present invention wherein thin sheet wrap or web 210 is wrapped around grip surface 212 of racket handle 214. Racket handle 214 is attached to tennis racket 202. Tennis racket 202 includes a yoke 216 which defines, on its inboard sides, an opening 218. Mounted within opening 218 is a casing 220 having, securely retained therein, the sound generator, portable power supply or battery, and associated electrical components. Casing 220 is retained within the yoke opening 218 via elastic, resilient straps 222 and 224 which are preferably heavy-duty rubberbands. Elastic straps 222 and 224 conveniently mate in channels 226 and 228 in the top and bottom faces of casing 220.

The portable power supply, sound generator and associated electrical components are electrically connected to the sensors or pressure switches in wrap 212 via a ribbon connector cable 230. Ribbon connector cable 230 leads to fiat ribbon cable 232 located beneath thin wrap 212 and ultimately to a switch bank 234 which is better illustrated in FIG. 11. Thin wrap 210 is releasably adhered to handle 214 with an appropriate adhesive or glue. The player may want to utilize the grip detector during normal practice and remove the grip detector from his or her racket for tournaments or other types of competition. By utilizing a releasable adherent, the grip detector can be removed without difficulty and later re-installed. Ribbon cable 230 and simple two-pronged jack 231 are utilized to electrically detach the grip detector from the electronics in casing 220. After detachment, the casing can be removed from yoke opening 218 by rolling elastic rubberbands 222 and 224 towards terminal end 235 of tennis racket 202. Otherwise, the player can keep casing 220 in yoke opening 218 since it does add a certain degree of weight to the tennis racket. In a preferred embodiment, the weight of the casing plus associated electronics is approximately 6–8 ounces. Of course, this weight can be significantly reduced by incorporating microelectronic devices and smaller battery or power supplies. The battery is typically a 9 volt battery and is a significant contributor to the weight of the grip detector. The location of the casing and associated electronics is close to the customary center of gravity of the sports racket. This location reduces the effect of the weight of the grip detector.

Figure 11:
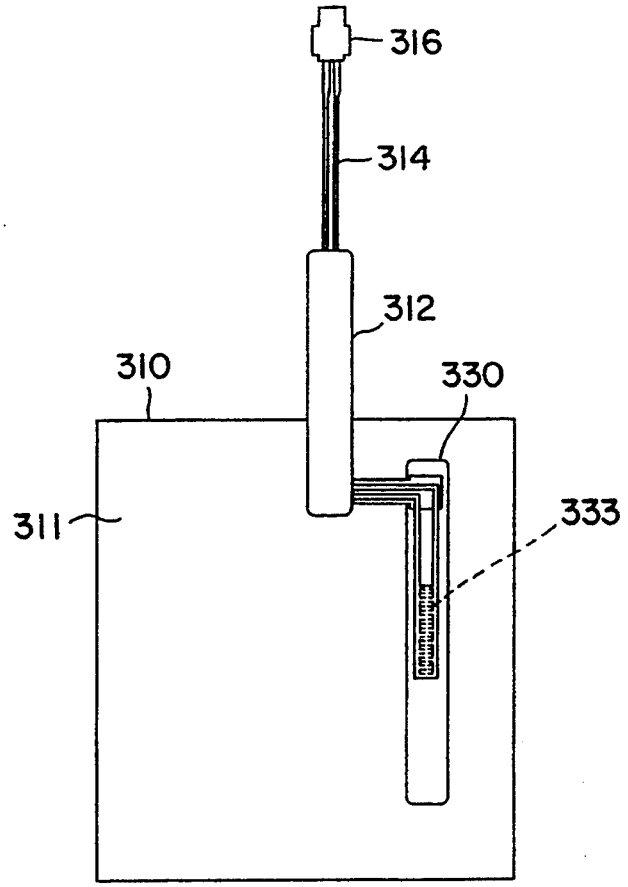
FIG. 11 diagrammatically illustrates a flat, strip switch, a ribbon cable connector and the grip wrap.
Figure 12:
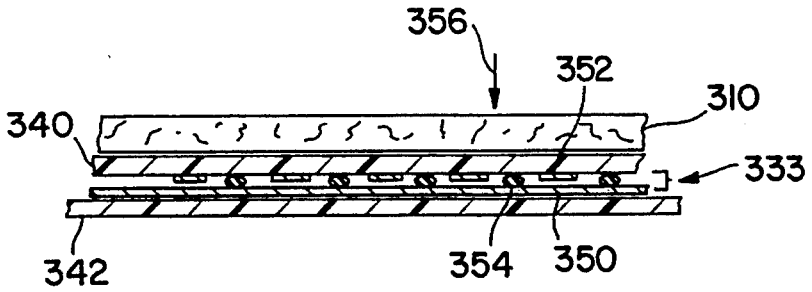
FIGS. 12 and 13 diagrammatically illustrate non-domed and domed membrane switches.

FIG. 11 diagrammatically illustrates a laid out version of wrap 310 with relatively straight, flat, electrical cable connectors 312 and flexible ribbon cable connector 314 leading to the female portion of jack 316. Wrap 310 carries a substantially rigid strip 330 on its lower surface or inboard surface and the strip 330 has a plurality of switches 333 located in a generally central region of strip 330 as well as wrap 310. In a preferred embodiment, switches 333 are non-domed membrane switches. These membrane switches are sandwiched between two relatively rigid layers of plastic, as illustrated in FIG. 12. Wrap 310 is generally a soft type of fabric or cloth that is sprayed with a releasable adherent on surface 311 prior to installation on the racket handle.

FIG. 12 diagrammatically illustrates a portion of the non-domed membrane switch 333 as well as wrap 310. Non-domed membrane switch 333 is sandwiched between upper, rigid plastic layer 340 and lower, rigid plastic layer 342. The non-domed membrane switch is currently made by Aztec Switch Company and is actuated with pressure of approximately 10–12 on the actuation gauge. Preferably, a new type of switch will be utilized in a further embodiment of the invention having an actuation levels between 8–10.

Figure 13:
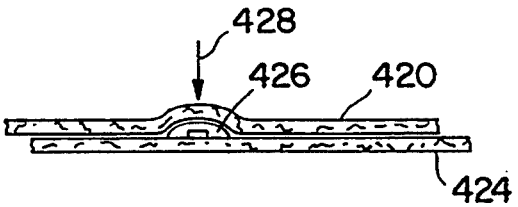

Switch 33 is diagrammatically illustrated as having a base or longitudinal metallic conductor 350, a plurality of upper lateral conductors, one of which is lateral conductor 352, and a plurality insulative spacers, one of which is spacer 354. When the player exerts compressive force as shown in the direction of arrow 356, insulator 354 compresses and lateral conductor 352 makes electrical connection with longitudinal conductor 350, thereby electrically closing the pressure switch. Of course, other types of switches including a domed membrane switch (shown in FIG. 13) can be utilized. FIG. 13 shows a modification of the present invention wherein the thin sheet wrap is a two part wrap or web including upper wrap 420, lower wrap 424, preferably made of a flexible, soft fabric, and domed switch 426. Upon compressive force shown in the direction of arrow 428 applied by the player's grip on the tennis or sports racket handle, switch 426 closes and thereby audibly indicates the correct degree of grip on the racket handle. Further, FIG. 13 shows that the switch can be mounted within the thin sheet wrap rather than simply on the inboard surface.

Figure 14:
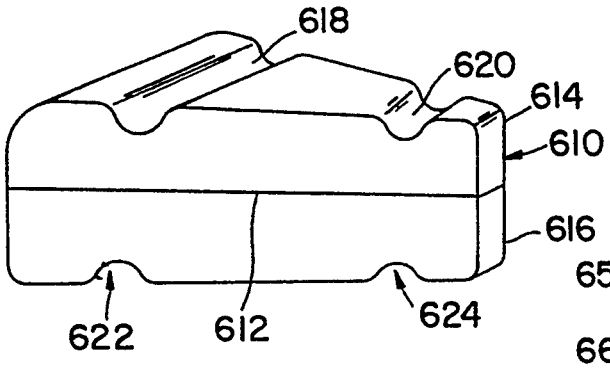
FIGS. 14, 15 and 16 diagrammatically illustrate various aspects of the casing, the retained battery, circuitry and sound generator.
Figure 15:
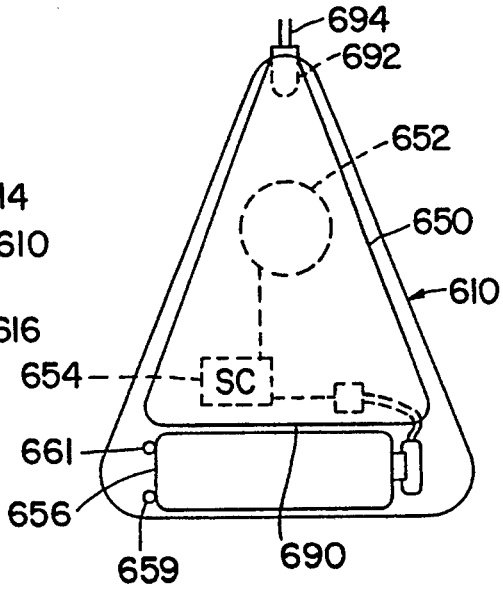

FIG. 14 diagrammatically illustrates the casing 610 having a longitudinal split or division 612 which divides casing 610 into upper part 614 and lower part 616. As shown in FIG. 14, elastic strap channels 618 and 620 are formed in the upper and the lower (see channels 622 and 624) faces of casing 610. To replace the battery or possibly adjust the threshold, the user removes casing 610 from the yoke opening of the racket and opens the casing along longitudinal division 612. FIG. 15 diagrammatically illustrates interior components of casing 610 and, particularly, a printed circuitboard 650 having a sound generator 652, signal conditioning (SC) electrical components 654 and a portable power supply, such as a 9 volt battery, 656. The 9 volt battery is secured by an interference fit within the interior of the casing via set pins 659 and 661. Further, back edge 690 of printed circuitboard 650 secures battery 656 in a longitudinal fashion. Also, base 692, having male connector pins 694 which ultimately lead to the ribbon connector cable and the pressure sensitive switches, is mounted on the forward end of printed circuitboard 650.

Figure 16:
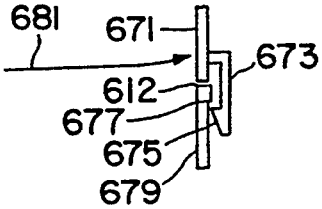

FIG. 16 diagrammatically illustrates a type of quick release for casing 610 to enable closure along longitudinal division 612. In particular, upper wall 671 includes a leg 673 having a finger 675 with a ledge which in turn cooperates with lip 677 on lower wall 679. To open the casing, the user applies force in the direction shown by arrow 681, thereby moving finger 675 away from lip or ledge 677 in lower side wall 679. This enables the user to lift upper side wall 671 away from lower side wall 679 along longitudinal division 612. The casing would include opposing latches as shown in FIG. 16.

Figure 17:
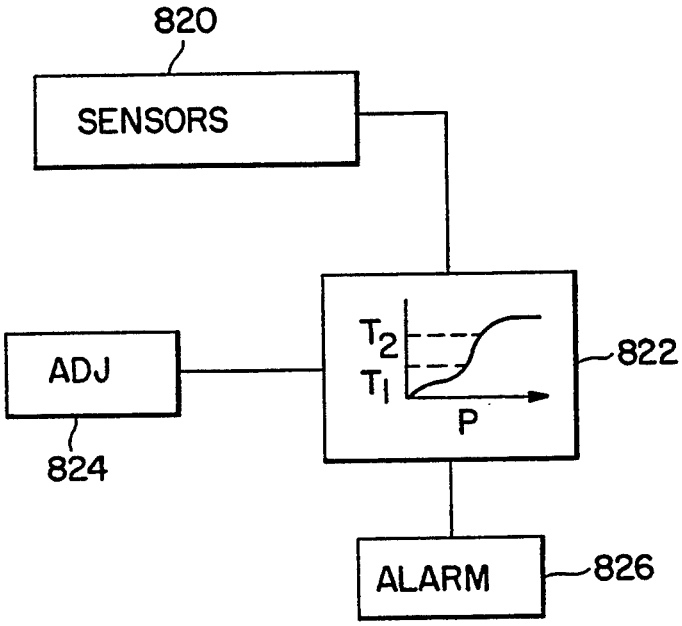
FIG. 17 diagrammatically illustrates an adjustable threshold circuit for the audible alarm.

FIG. 17 diagrammatically illustrates another thresholding system for the present invention. Pressure sensors 820 are electrically connected to a thresholding device 822 having an operator input 824. The operator input can select tone T2 which is activated upon a higher pressure, or tone T1 which is activated on a lower pressure. Alarm 826 would generate two different tones or two different amplitudes of the same tone based upon the degree of pressure. This may assist the player in his or her game.

Figure 18A:
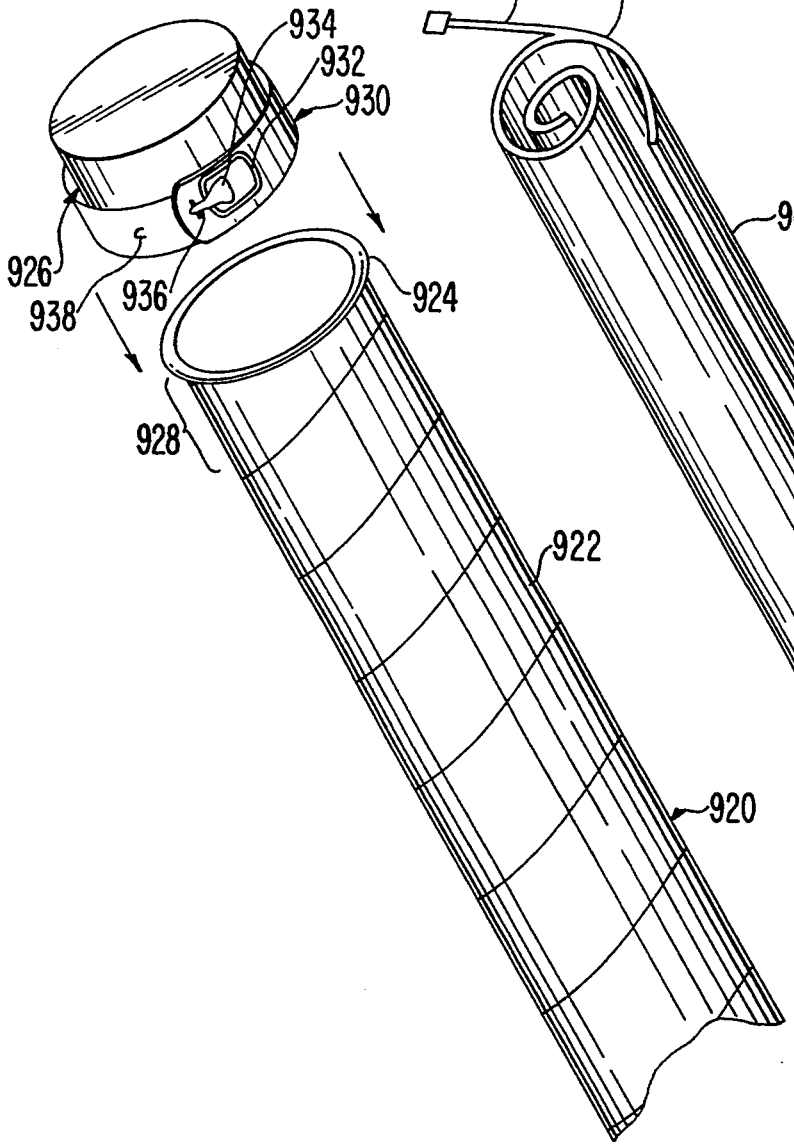
FIGS. 18A and 18B diagrammatically illustrate components of the grip sensor and a golf club handle.
Figure 18B:
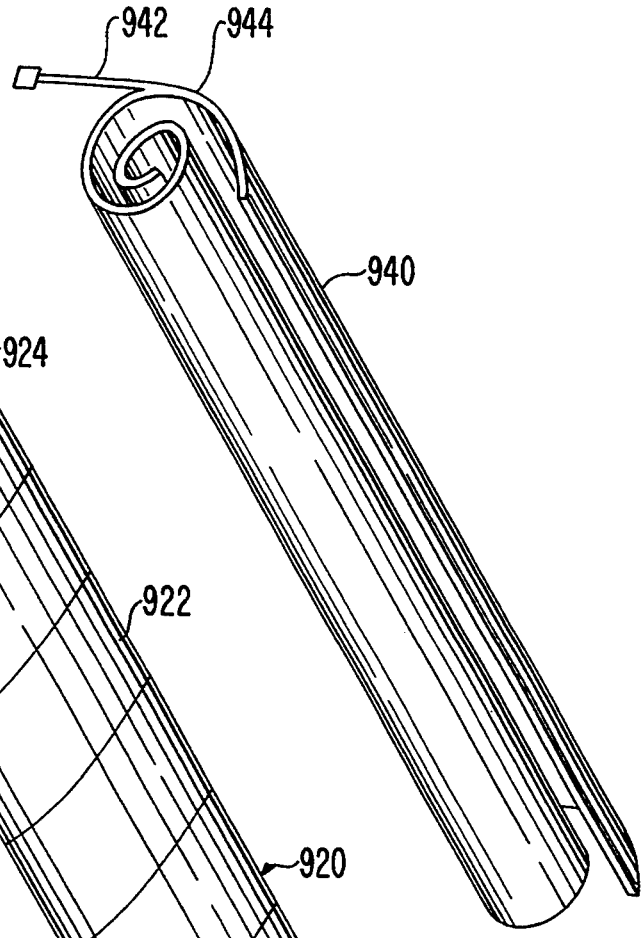

FIGS. 18A and 18B diagrammatically illustrate the grip sensor for a golf club handle. FIG. 18A shows golf club handle 920 having a grip surface 922 and a slightly raised, circumferential knob end 924. An end cap 926 is removably mounted onto end region 928 of grip surface 922 via compressive spring or hose clamp mechanism 930. Spring clamp 930 includes a wire loop or ring 932 which is movably attached to lever arm 934. Lever arm 934 is rotatably attached to spring clamp 930 at pivot point 936. In order to clamp spring clamp 930 onto end region 928 of gripping surface 922, wire loop 932 is moved over and caught on radially protruding tab 938. When arm 934 is moved in an opposite direction or away from tab 938, loop 932 pulls tab 938 towards pivot point 936 and spring clamp 930 radially compresses. When clamp 930 radially compresses around end region 928, end cap 926 is removably mounted onto gripping surface 922.

FIG. 18B diagrammatically illustrates thin wrap 940 having flat wire connector 942 protruding beyond upper end surface 944.

Figure 19A:
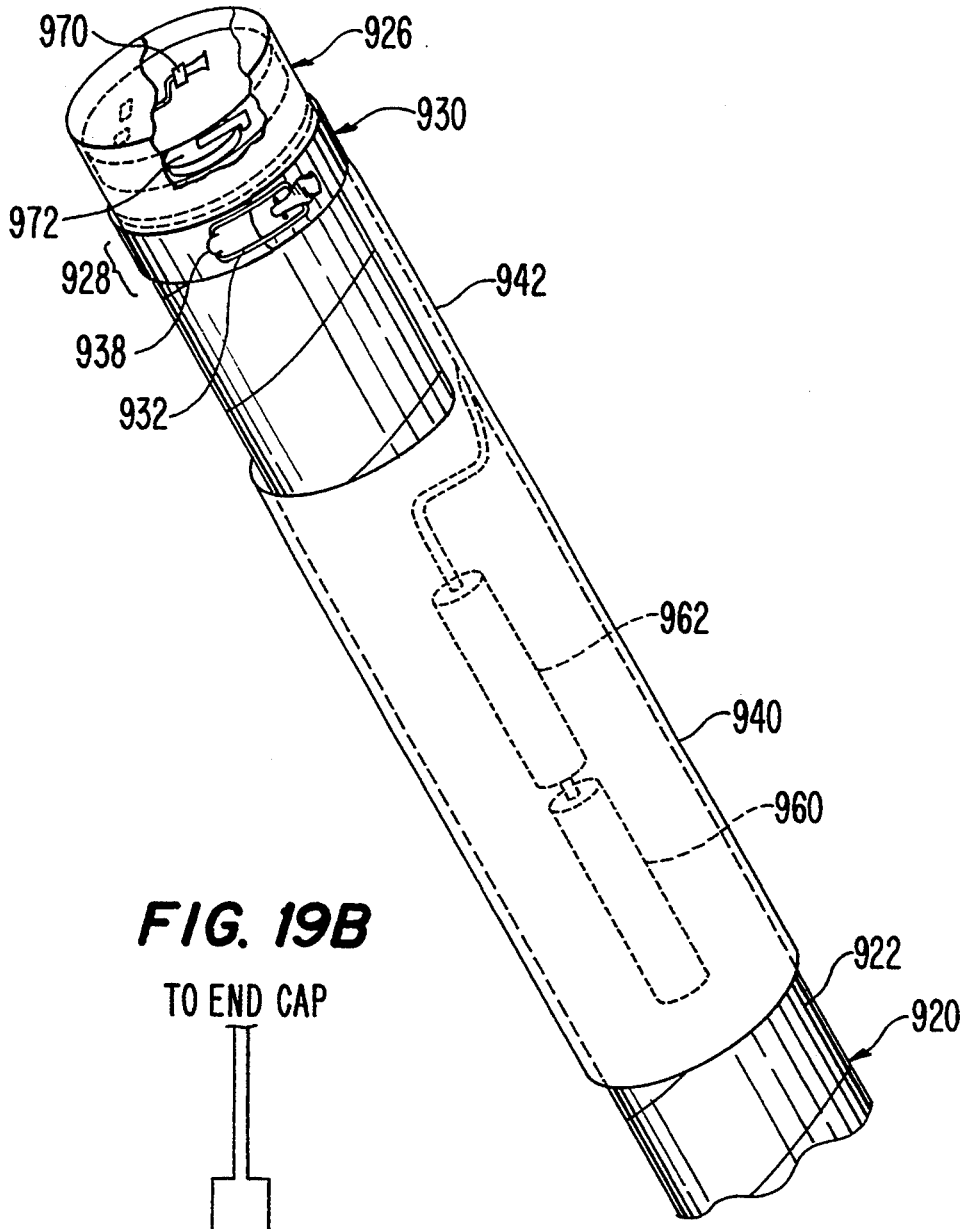
FIGS. 19A and 19B diagrammatically illustrate the grip sensor attached to the golf club handle and the switch configuration, respectively.

FIG. 19A diagrammatically illustrates grip sensor attached to grip surface 922 of golf club handle 920. Thin wrap 940 retains, either on its inboard surface or at an interior position, forward and aft, serially connected membrane switches 960 and 962. Switches 960 and 962 are serially connected, such that the user must compress both switches 960 and 962 in order to activate audible alarm in end cap 926. Forward and aft switches 960 and 962 are electrically connected to end cap 926 via flat wire connector 942. Spring wire clamp 930 has wire loop 932 mechanically connected to tab 938 thereby removably mounting end cap 926 to end region 928. End cap 926 is partially broken away to show audible alarm 970 and battery 972.

Figure 19B:
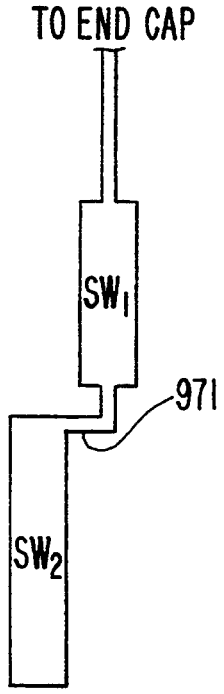

FIG. 19B shows membrane switch $SW_1$ electrically serially connected to forward membrane switch $SW_2$ via transverse, flatwire connector 971 which circumferentially off sets the aft switch from forward switch.

In operation, the golf grip sensor includes forward and aft serially connected membrane switches such that the golfer must release his or her forward grip hand in order to turn off the audible alarm. By relaxing his or her forward grip hand until the beginning of the downstroke, the golfer is forced to relax his or her backhand during the backstroke. This causes the golfer to properly carry and swing the golf club. This also reduces stress during the back swing. In contrast, the aft switch 962 should be compressed by the golfer during the back swing as well the forward swing. The golfer can train him or herself by compressing both forward switch 960 and aft switch 962 during the down swing of the golf club.

Figure 20A:
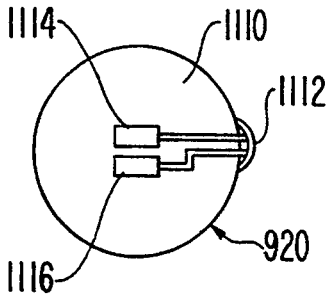
FIGS. 20A and 20B illustrate a contact system for electrically coupling the power supply and audio components with the switches in the golf club grip sensor.
Figure 20B:
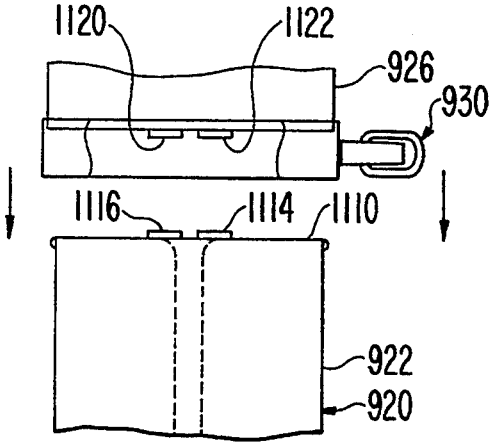

FIGS. 20A, 20B, 21, 22, 23 and 24 show various mechanisms to either attach the end cap to the end surface of the golf club handle or to electrically connect the power supply, sound generator and associated electronics in the end cap to the switches in the thin wrap of the grip sensor. FIG. 20A shows a top view of golf club end surface 1110. A flat connector wire 1112 runs upward from the thin wrap on grip surface 922. Metal contact points 1114 and 1116 are releasably adhered to top surface 1110 of golf club 920. This releasable adherence can be provided by some type of spray-on glue. FIG. 20B shows grip surface 922 of golf club 920 and top contacts 1114 and 1116 releasably adhered to end surface 1110 of the golf club. End cap 926 has spring clamp latch 930. Complementary contacts 1120 and 1122 are disposed inboard the spring latch (which is shown as partially broken away). End cap contacts 1120 and 1122 mate with contacts 1116 and 1114. This mating and electrical connection connects the audio electronics and power supply to the membrane switches in the grip sensor.

Figure 21:
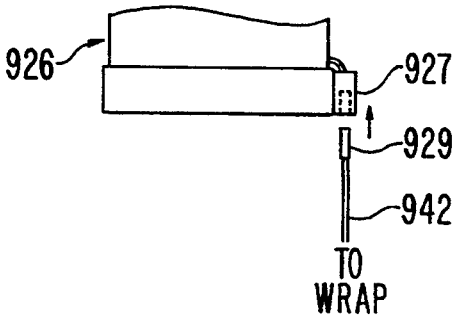
FIG. 21 diagrammatically illustrates another type of connection between the grip wrap on the golf club handle sensor and the end cap carrying the battery and sound generator.
Figure 22:
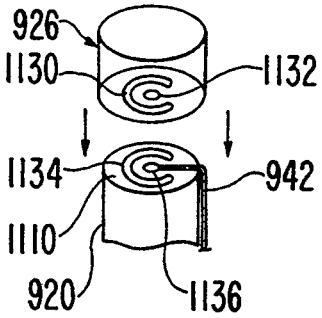
FIG. 22 diagrammatically illustrates another connection system to electrically connect the end cap with the wrap of the grip sensor.

FIG. 21 shows end cap 926 having a female connector 927 mounted on the spring latch, within which is inserted male connector 929 of flat wire connector 942. Accordingly, FIG. 21 shows an alternate electrical connection means to connect the electronics in the end cap to the membrane switches in the thin wrap. FIG. 21 shows another connection means utilizing, below end cap 926, an outer electrically contact 1130 and an inner electrical contact 1132. The outer electrical contact 1130 on end cap 926 complements outer electrical contact 1134 on end surface 1110 of golf club handle grip surface 920. Inner electrical contact 1136 complements and is electrically connected to inner contact 1134. Outer and inner contacts 1134 and 1136 are electrically connected to the thin wrap via ribbon connector 942.

Figure 23:
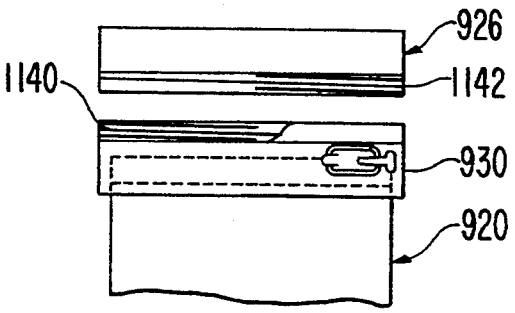
FIG. 23 diagrammatically illustrates a screw-on end cap.

FIG. 23 diagrammatically illustrates another way of removably attaching end cap 926 to golf club handle 920. In the illustrated embodiment, a spring clamp 930 includes, on an inboard axial end surface, female threads 1140. End cap 926 includes, on one of its outer axial end surfaces, male threads 1142. To removably attach end cap 926 to golf club handle 920, end cap 926 is simply threaded onto spring clamp 930 by matching threads 1142 and 1140. In this embodiment, the electrical contact system described above in connection with FIG. 21 can be used to connect the electronics and the power supply to the grip sensor switches. The end cap may be transferred from golf club to golf club with relative ease. The grip sensor wrap would remain mounted on each club but the end cap power and electronics would be moved from club to club.

Figure 24:
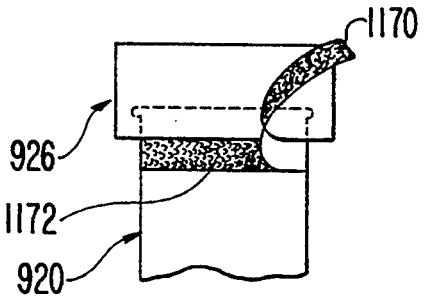
FIG. 24 diagrammatically illustrates the use of a hook and loop attachment mechanism for the end cap.

FIG. 24 diagrammatically illustrates end cap 926 being removably attached to golf club handle 920 via a VELCRO-type hook and loop attachment. Essentially, hook strap 1170 mechanically attaches to loop strap 1172.

Figure 25:
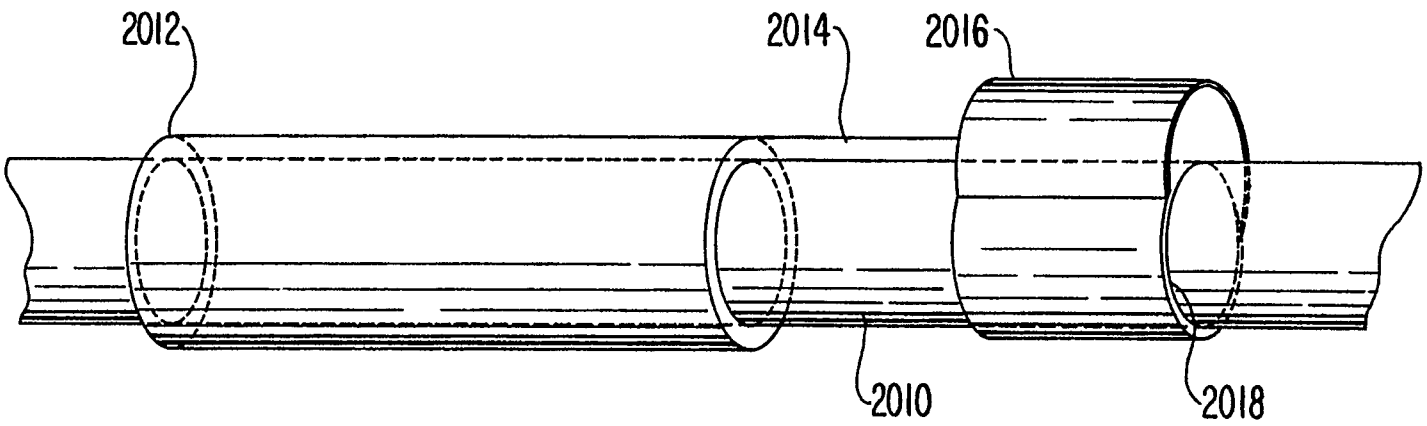
FIG. 25 diagrammatically illustrates the bio-feedback, stress reduction training mechanism on a hand grip surface.

FIG. 25 diagrammatically illustrates a bio-feedback, stress reduction training device for audibly indicating excessive gripping force on a hand grip surface 2010. Thin wrap 2012 contains and retains one or more membrane switches on its interior. These switches are electrically connected via ribbon cable 2014 to electronics box 2016. Electronics box 2016 includes a power supply and an audible alarm as discussed above. Electronics box 2016 is removably attached to grip surface 2010 by any reasonable attachment mechanism 2018 which may be hook and loop VELCRO, spring clamp, strap, tie or other type of mechanism. In use, the person places his or her hand around thin wrap 2012 which contains, in its interior portion or on an inboard surface, one or more preferably non-domed membrane switches. The user can train him or herself by relaxing his or her grip dependent upon the audible sounds generated by electronics 2016. For example, while operating a hand glider, it is important to relax the grip and hence the upper body of the user during certain times in flight. The grip sensor forces the user to relax excessive gripping force on the hand.

The hand is known as a strong indicator of stress in the upper body as well as throughout the entire body. By forcing the hand to relax, thereby turning off the audible alarm, the user reduces stress during the athletic event until the time that such force is necessary. In tennis, the time for the appropriate delivery of gripping force is immediately before the tennis racket strikes the ball. In golf, the appropriate time to apply a high level of grip on the golf club is immediately before and during the downstroke golf swing. During hand gliding, it is important that the user relax his or her body. Commonly, tense individuals apply an excessive gripping force to hand bars. By using an excessive grip sensor, the user can teach him or herself to relax his or her grip via the audible bio-feedback mechanism and thus reduce stress during the athletic event.

Further, the audible sound can be used to trigger visualization during critical portions of the sporting event. For example, in tennis, when the tennis player hears the audible alarm at the proper time immediately before the racket hits the ball, the tennis player can visualize a perfect swing and form. This visualization enhances the play of the player.

It should be noted that piezoelectric sensors may be used in this sheet wrap 940 and 2012, as discussed above with respect to the rackets.

Conclusions and Ramifications of the Invention

The preferred embodiment describes the use of the invention as it would relate to tennis. While tennis players would benefit greatly from the invention, all sports players would be able to profit from the invention. Due to the similarities between the two sports, racquetball players would equally gain from the use of the invention.

Golf players have often sought a method of assuring a proper grip on the golf clubs that they use. The invention will aid them greatly. Golf is a sport that the player must get beyond the basics if they wish to master the sport.

Baseball is another sport that requires proper hand position. Although to a lesser degree than the other sports mentioned.

All sports that require a grip on the equipment would benefit from the invention. It will be possible to have the device equipped with a manually operated switch. The individual user would be able to turn the device on and off. The device could be modified so that the audio signal would be activated when the device was not being properly gripped. This would benefit the player greatly. This would further allow for instructors of the various sports to be notified that the proper hand position has been lost during training.

Similarly this device could be used for many situations that require an individual to hold an item during use where the individual must also stay attentive. The device would be capable of warning the user that his attention is diminished.

The claims appended hereto are meant to cover modifications and changes within the spirit and scope of the present invention.

What is claimed is:

1. A training device for audibly indicating a proper grip on a handle of a golf club comprising:
   - a thin sheet wrap sized to wrap around an outside grip surface of said golf club handle;
   - a forward and an aft, serially connected, non-domed membrane switch retained by said thin sheet wrap;
   - releasable means for securing said thin sheet wrap on said handle;
   - a portable power source electrically coupled to an audible alarm, both of which are retained on an end of said golf club handle; and
   - electrical connectors coupling said switches with said power source and said audible alarm such that upon closure of said switches, said alarm sounds.

2. A training device for audibly indicating a proper grip on a golf club handle comprising:
   - a thin sheet wrap sized to wrap around an outside grip surface of said golf club handle;
   - a forward and an aft, serially connected, membrane switch retained by said thin sheet wrap;
   - releasable means for securing said thin sheet wrap on said golf club handle;
   - a portable power source electrically coupled to an audible alarm, both of which are retained on an end of said golf club handle; and
   - electrical connectors coupling said switches with said power source and said audible alarm such that upon closure of said switches, said alarm sounds.

3. A device as claimed in claim 2 wherein said switches have a thickness which does not substantially exceed a thickness of said thin sheet wrap, said switches being non-domed membrane switches.

4. A training device as claimed in claim 2 including a releasable adherent on an inside surface of said wrap.

5. A training device as claimed in claim 2 wherein said switches are located within said wrap.

6. A training device as claimed in claim 2 including a plurality of serially connected switches retained by said wrap and electrically connected via detachable connectors to said power source and said alarm.

7. A training device as claimed in claim 6 wherein said power source is a battery and said battery and said audible alarm are housed in an end cap, said end cap being releasably mounted to said end of said golf club handle with a releasable mounting means.

8. A training device as claimed in claim 2 wherein said power source is a battery and said battery and said audible alarm are housed in an end cap, said end cap being releasably mounted to said end of said golf club handle with a releasable mounting means.

9. A training device as claimed in claim 8 wherein said releasable mounting means is one from the group of a hook and loop, a spring clamp and a threaded coupler.

10. A training device for audibly indicating a proper grip on a golf club handle comprising:

a thin sheet wrap sized to wrap around an outside grip surface of said golf club handle;

a piezoelectric switch retained by said thin sheet wrap;

releasable means for securing said thin sheet wrap on an end of said golf club handle;

a portable power source electrically coupled to an audible alarm, both of which are retained on an end of said golf club handle; and electrical connectors coupling said switch with said power source and said audible alarm such that upon closure of said switch, said alarm sounds.

11. An electronic training method for audibly indicating a proper hand grip by a player on a golf club handle comprising the steps of:

removably mounting at least two serially connected membrane switches with a wrap about said golf club handle;

mounting a portable power supply and an audible alarm on an end of said golf club handle and electrically connecting said power supply, said alarm and said switches together;

compressibly closing said switches with said proper hand grip over a distance which does not substantially exceed a thickness of said wrap; and, audibly announcing said closure of said switches by activation of said alarm.

12. An electronic training method as claimed in claim 11 including the step of releasably adhering said wrap on said golf club handle.

13. An electronic training method as claimed in claim 12 including issuing stepwise audible alarms upon detection of different levels of compression of said switches.

14. A bio-feedback, stress reduction training device for audibly indicating excessive gripping force on hand grip surface comprising:

a thin sheet wrap sized to wrap around said hand grip surface;

a membrane switch retained by said thin sheet wrap;

releasable means for securing said thin sheet wrap on said hand grip surface;

a portable power source electrically coupled to an audible alarm, both of which are retained near said hand grip surface; and electrical connectors coupling said switch with said power source and said audible alarm such that upon closure of said switch, said alarm sounds.

15. A device as claimed in claim 14 wherein said switch has a thickness which does not substantially exceed a thickness of said thin sheet wrap, said switch being a non-domed membrane switch.

16. A training device as claimed in claim 14 wherein a plurality of switches are retained by said wrap, said plurality of switches being serially electrically connected with said power source and said alarm.

17. A training device as claimed in claim 14 wherein a plurality of switches are retained by said wrap, said plurality of switches being serially electrically connected with said power source and said alarm.

18. A training device as claimed in claim 14 including a releasable adherent on an inside surface of said wrap.

19. A training device as claimed in claim 18 wherein said switch is located within said wrap.

20. A training device as claimed in claim 19 including a variable threshold circuit for said audible alarm to enable a player to adjust the level of activation of an audible alarm signal based upon pressure exerted by said gripping force on said hand grip surface.

21. A training device as claimed in claim 20 including a variable threshold circuit to generate more than one predetermined alarms for said audible alarm to enable a user to adjust the level of activation of an audible alarm signal based upon gripping force exerted on said hand grip surface.

22. A bio-feedback, stress reduction training device for audibly indicating excessive gripping force on a hand grip surface comprising:

a thin sheet wrap sized to wrap around said hand grip surface;

a piezoelectric switch retained by said thin sheet wrap;

releasable means for securing said thin sheet wrap on said hand grip surface;

a portable power source electrically coupled to an audible alarm, both of which are retained near said hand grip surface; and electrical connectors coupling said switch with said power source and said audible alarm such that upon closure of said switch, said alarm sounds.

23. An electronic bio-feedback, stress reduction training method for audibly indicating an excessive gripping force on a hand grip surface comprising the steps of:

removably mounting at least one membrane switch with a wrap about said racket handle;

mounting a portable power supply and an audible alarm near said hand grip surface and electrically connecting said power supply, said alarm and said switch together;

compressibly closing said switch with said excessive gripping force over a distance which does not substantially exceed a thickness of said wrap; and, audibly announcing said closure of said switch by activation of said alarm.

24. An electronic training method as claimed in claim 23 including the step of releasably adhering said wrap on said hand grip surface.

25. An electronic training method as claimed in claim 24 including issuing stepwise audible alarms upon detection of different levels of compression of said switch.

* * * * *